US006598315B1

(12) United States Patent
Heikkiläet al.

(10) Patent No.: US 6,598,315 B1
(45) Date of Patent: Jul. 29, 2003

(54) NOZZLE ARRANGEMENT IN AIRBORNE WEB-DRYING AND METHOD FOR IMPROVING HEAT TRANSFER IN AIRBORNE WEB-DRYING

(75) Inventors: Pertti Heikkilä, Raisio (FI); Richard Solin, Kemiö (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/019,535

(22) PCT Filed: Jun. 28, 2000

(86) PCT No.: PCT/FI00/00579

§ 371 (c)(1),
(2), (4) Date: Mar. 22, 2002

(87) PCT Pub. No.: WO01/02643

PCT Pub. Date: Jan. 11, 2001

(30) Foreign Application Priority Data

Jun. 30, 1999 (FI) ..... 991497

(51) Int. Cl.[7] ..... F26B 3/00

(52) U.S. Cl. ..... 34/461; 34/638; 34/641; 34/643

(58) Field of Search ..... 34/461, 464, 629, 34/632, 636, 638, 641, 643

(56) References Cited

U.S. PATENT DOCUMENTS 3,559,301 A * 2/1971 Fraser ..... 34/641
3,776,440 A * 12/1973 Frost et al. ..... 242/615.11
3,982,328 A 9/1976 Gustafsson et al.
4,290,210 A 9/1981 Johansson
4,384,666 A 5/1983 Koponen et al.
4,719,708 A * 1/1988 Karlsson et al. ..... 34/636
5,105,562 A 4/1992 Hella et al.
5,471,766 A * 12/1995 Heikkila et al. ..... 34/461
6,006,446 A * 12/1999 Pagendarm ..... 34/633

FOREIGN PATENT DOCUMENTS

| | | |
|---|---|---|
| EP | 0 561 256 A1 | 9/1993 |
| WO | WO 95/14199 | 5/1995 |
| WO | WO 96/18074 | 6/1996 |

* cited by examiner

*Primary Examiner*—Ira S. Lazarus
*Assistant Examiner*—Kathryn S. O'Malley
(74) *Attorney, Agent, or Firm*—Lathrop & Clark LLP

(57) ABSTRACT

A nozzle arrangement in an airborne web-drying apparatus for drying a coated paper web (10) or the like. The nozzle arrangement comprises at least one overpressure nozzle (14), which is arranged to blow drying air both in the web's travel direction and against the web's travel direction. The nozzle arrangement comprises further a direct impingement nozzle (16) combined with the exit side and/or the entrance side (26) of the overpressure nozzle, in which direct impingement nozzle a plurality of nozzle slots or nozzle orifices (17) are formed in order to blow drying air mainly perpendicularly toward the web. The perpendicular distance ($a_1$) from the nozzle surface (30) of the direct impingement nozzle (16) to the web is larger than the perpendicular distance ($a_2$) from the supporting surface (32) of the overpressure nozzle (14) to the web.

23 Claims, 6 Drawing Sheets

NOZZLE ARRANGEMENT IN AIRBORNE WEB-DRYING AND METHOD FOR IMPROVING HEAT TRANSFER IN AIRBORNE WEB-DRYING

The object of the present invention is a nozzle arrangement in an airborne web-drying apparatus and a method for improving the heat transfer in airborne web-drying, the apparatus and the method being defined in the preambles of the independent claims presented below.

Then the object of the invention is typically a nozzle arrangement which comprises at least one overpressure nozzle extending transversely of the web and having on both sides of the nozzle, i.e. on the entrance and exit sides of the nozzle, a nozzle slot extending across the web, in which case the nozzle slots on the opposite sides of the nozzle comprise one nozzle slot extending across the web or a row of successive nozzle orifices. The nozzle slots are arranged to blow drying air jets obliquely against each other, or they are arranged to blow drying air jets, which are guided against each other with the aid of curved Coanda-surfaces. The arrangement further comprises at least one direct impingement nozzle extending across the web, in which case a plurality of nozzle slots or nozzle orifices are formed in this direct impingement nozzle for blowing drying air mainly perpendicularly against the web. Advantageously the nozzle orifices or slots of the direct impingement nozzle are arranged in one or more rows, or otherwise evenly distributed on the supporting surface of the direct impingement nozzle.

A plurality of overpressure nozzles or direct impingement nozzles are typically arranged in an alternating succession on both sides of the web. Thereby an overpressure nozzle and a direct impingement nozzle are arranged opposite each other, as shown e.g. in the international patent publication WO 95/14199. In the solution presented in the WO-publication the space between each overpressure nozzle and the adjacent direct impingement nozzle forms a discharge passage for the wet discharge air. The discharge passages are ineffective regions regarding the drying of the web.

The aim is to continuously improve the effect of the airborne web-drying for instance in order to be able to make the drying faster and/or to reduce the size of the dryer. One economical means to improve the effect of airborne web-drying is to increase the nozzle temperature. However, it is not possible to increase the nozzle temperature in some applications, or the desired effect can not be obtained with this single measure.

The object of the present invention is to provide an improved nozzle arrangement and a method which are able to increase the effect of airborne web-drying.

A particular object is to provide a nozzle arrangement which is easy to realise in airborne web-drying apparatuses of different types.

A further object is to provide an improved nozzle arrangement and method which do not require substantial extra space for the airborne web-drying apparatus.

In order to reach the above-mentioned objects the nozzle arrangement and method according to the invention in airborne web-drying are characterised in what is defined in the characterising parts of the independent claims presented below.

The solution according to the invention uses nozzle assemblies which in the same structure combine at least one overpressure nozzle and at least one direct impingement nozzle. The assembly of overpressure nozzle and direct impingement nozzle is advantageously mounted in a common frame structure and in a common nozzle box. The nozzle assembly comprises typically an overpressure nozzle and a direct impingement nozzle arranged on both sides of the overpressure nozzle, i.e. on its entrance and exit sides. Thus no conventional discharge passage for wet air is formed between the overpressure nozzle and the direct impingement nozzles in the nozzle assembly. Compared to conventional solutions a larger part of the area of the dryer can in this way be utilised in the actual drying process. The discharge passages for the wet air are arranged between the different nozzle assemblies. Each passage discharges drying air blown by both the overpressure nozzle and the direct impingement nozzle. The direct impingement nozzles are arranged in relation to the web, so that they do not hinder air from being discharged from the overpressure nozzle. The web will further facilitate the air discharge from the direct impingement nozzle region in the travel direction of the web.

In another typical solution according to the invention a direct impingement nozzle is arranged on the entrance or exit side in the travel direction of the web of the over pressure nozzle and directly attached to the overpressure nozzle, so that an assembly comprising an overpressure nozzle and one direct impingement nozzle is formed.

The distance between the nozzle slots of the overpressure nozzle and the first nozzle orifice row closest to the overpressure nozzle is advantageously >30 mm but <100 mm, typically 40 to 60 mm.

In conventional airborne web-drying solutions there is a relatively wide discharge air passage between each successive nozzle pair. Then the actual nozzles cover only less than half of the total area. In this case there will be a poor heat transfer in the region of the discharge air passage, as no air jets are directed at the web in this region. In the solution according to the invention the drying utilises also a part of the empty space left between the individual nozzles in conventional dryers. The direct impingement arranged in connection with the overpressure nozzle enables an increased total amount of drying air to be directed at the web, i.e. in this region the heat-transfer coefficient can be increased and the heat transfer can be made more efficient. In measurements it was found that a considerably increased heat transfer can be achieved with the solution according to the invention. The heat transfer can be made more efficient with the solution according to the invention, also when the temperature of the drying air must kept very low, such as for instance in the drying of "thermal coatings".

Each nozzle assembly according to the invention has typically nozzle orifices in one or two direct impingement nozzle sections, the nozzle orifices occupy an area having a total length of 20 to 250 mm in the travel direction of the web, typically >50 mm, most typically >100 mm, or covering 10 to 60% of the length of the nozzle distribution. A direct impingement nozzle can of course also have only one row of nozzles or nozzle orifices, in which case the area is very small.

The nozzle orifices of the direct impingement nozzle parts have typically a diameter of 2 to 10 mm, most typically about 5 mm, and the nozzles are arranged at a distance from each other which is 10 to 50 mm, typically 20 to 30 mm, both in the web cross direction and in the web travel direction. The nozzle orifices are typically arranged in rows in the cross direction of the web. There are typically 2 to 7 successive rows of nozzle orifices in the travel direction of the web. Advantageously the nozzle orifices in different rows are overlapping, so that the total coverage of the orifices is as large as possible. The nozzle orifices can also be arranged evenly on the supporting surface of the nozzle in other ways. An airborne web-drying apparatus contains typically several successive nozzle assemblies on both sides of the web to be dried.

In steam-heated dryers the heat source forms an upper limit for the temperature. Also in this case the drying can be made more effective with the solution according to the invention. An effective nozzle can increase the drying effect also in gas-heated dryers.

On the other hand the solution according to the invention can also be used in small spaces, particularly in short spaces, in order to maximise the drying effect.

The gap between two successive assemblies according to the invention forms a discharge passage for wet discharge air. The nozzle assemblies are disposed on different sides of the web to be dried, advantageously in such a manner that there is always a part of a nozzle assembly, preferably an overpressure nozzle part, on the other side of the web opposite to a discharge passage. The intention is to avoid a situation where two discharge passages would be located opposite each other. The aim is that the web is guided at all points by drying air blows, at least from one side of the web. An aim is also usually to arrange the overpressure nozzles in the airborne web-drying apparatus so that they cause the web to travel forward like a sine wave.

In an advantageous nozzle arrangement solution according to the invention the nozzle surface of the direct impingement nozzle, i.e. the supporting surface of the nozzle, is at a longer perpendicular distance from the web line than the overpressure nozzle. The web line means typically a straight line located centrally between the drying boxes on opposite sides of the web. The web itself travels along the web line, but however, often like a sine wave. The distance of the nozzle surface of a direct impingement nozzle from the web line is advantageously 5 to 40 mm, typically 10 to 15 mm, longer than the distance of the supporting surface of an overpressure nozzle from the web line. The perpendicular distance of the nozzle surface of a direct impingement nozzle from the web line is typically about 20 to 30 mm. This ensures a discharge gas space on the entrance and exit sides of the nozzle between the direct impingement nozzle and the web, for air blown from the nozzle slots on the entrance and exit sides of the overpressure nozzle.

When the nozzle surface of the direct impingement nozzle is located at a greater distance from the web line than the nozzle surface or the supporting surface of the overpressure nozzle, it is guaranteed that the air jets from the direct impingement nozzle part do not interfere with the operation of the overpressure nozzle. Preferably the structure of the direct impingement nozzle and its air jets must be dimensioned, so that the air jets turn suitably away from the overpressure nozzle toward, the discharge passage of the return air, i.e. the discharge air, and do not tend to form an obstruction to the air flow leaving the overpressure nozzle.

The discharge passage between two adjacent nozzle assemblies is advantageously dimensioned so that it can remove, regarding the travel direction of the web

- the discharge air from the exit side of the overpressure nozzle on the upstream side of the discharge passage, and the discharge air from the direct impingement nozzle arranged on the exit side of this overpressure nozzle, and
- the discharge air from the entrance side of the overpressure nozzle on the downstream side of the discharge passage, and the discharge air from the direct impingement nozzle arranged on the entrance side of this overpressure nozzle.

The area of the discharge passage in the web direction is advantageously less than 40% of the corresponding total area of the airborne web-drying apparatus, i.e. of the corresponding area covered by the nozzles and the discharge passage.

The total area ($A_1$) of the openings of the direct impingement nozzle or nozzles in each direct impingement nozzle and overpressure nozzle assembly is typically

- about 40 to 100% of the total area ($A_2$) of the nozzle slots of the overpressure nozzle when there is a direct impingement nozzle only on one side, and
- about 40 to 150% of the total area ($A_2$) of the nozzle slots of the overpressure nozzle when there is a direct impingement nozzle on both sides of the overpressure nozzle.

The width of the nozzle slots of the overpressure nozzles is typically about 1.5 mm. The open area of the slots of the overpressure nozzles is 1 to 2%, typically 0.8 to 1.5%, most typically about 1.2% of the total area of the airborne web-drying apparatus. The open area of the orifices of the direct impingement nozzles is correspondingly about 0.5 to 1.5% of the total area of the airborne web-drying apparatus. Sometimes smaller or larger opening areas can come into question.

In some cases, particularly when the width of the direct impingement nozzle in the web travel direction is relatively large, the nozzle surface of the direct impingement nozzle arranged on the exit side of the overpressure nozzle can be curved, so that its distance from the web increases in the travel direction of the web.

With the method according to the invention the heat transfer in airborne web-drying can be effectively increased by blowing drying air directly on the exit and/or entrance side of the overpressure nozzle, mainly perpendicularly against the web, with the aid of a direct impingement nozzle having the nozzle surface at a larger distance from the web than the nozzle surface of the overpressure nozzle. Thus the solution according to the invention ensures that the drying air blown from the nozzle slots on the exit side and/or the entrance side of the overpressure nozzle and the drying air blown from the direct impingement nozzle form wet discharge air, which can be guided away from the web region via a discharge passage formed on the exit side and/or entrance side of the direct impingement nozzle, without interfering with the operation of the overpressure nozzle.

The invention is described in more detail below with reference to the enclosed drawings, in which FIG. 1 shows, as seen from one side, an airborne web-drying apparatus provided with a nozzle arrangement according to the invention;

Figure 1:
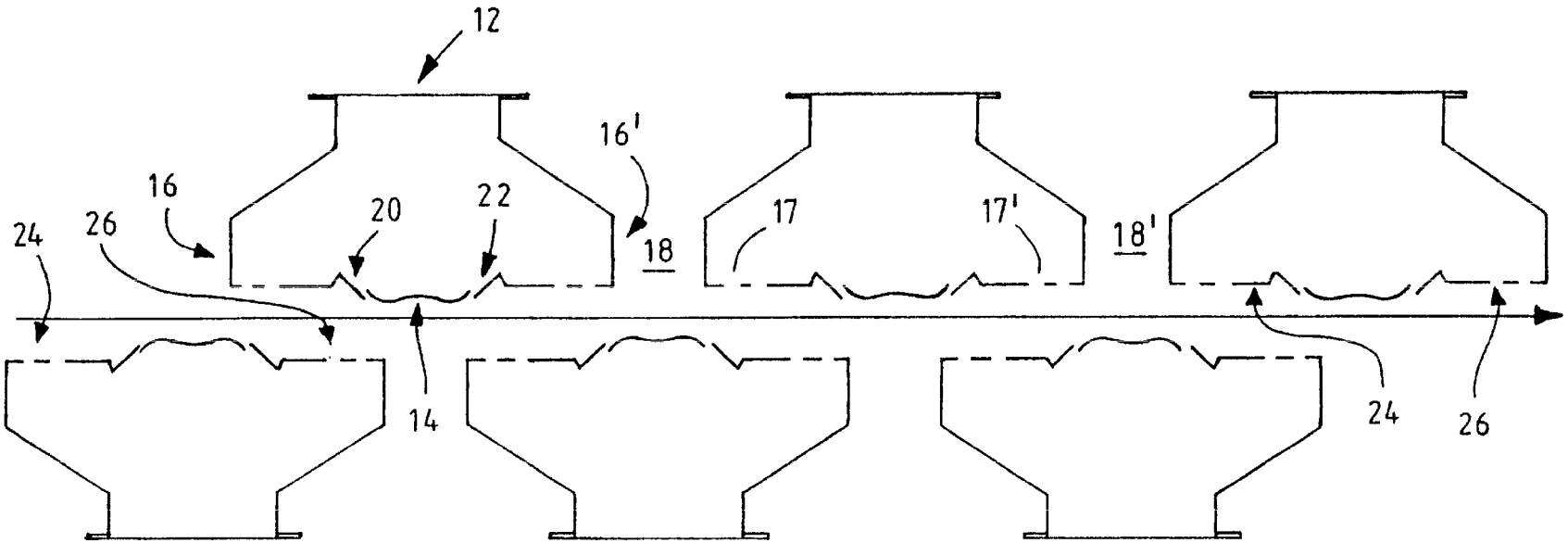

FIG. 1 shows an airborne web-drying apparatus provided with an advantageous nozzle arrangement according to the invention. In the airborne web-drying apparatus nozzle assemblies 12 are arranged both above and below the web 10, each nozzle assembly being formed by an overpressure nozzle 14 and direct impingement nozzles 16, 16' arranged symmetrically on both sides of the overpressure nozzle. A discharge passage 18, 18' for the discharge air is arranged in the gaps between adjacent nozzle assemblies.

In the case of FIG. 1 each overpressure nozzle 14 has two nozzle slots 20, 22. A first or entrance side nozzle slot 20 is on the entrance side 24 of the overpressure nozzle 14, and an exit side nozzle slot 22 is on the exit side 26 of the nozzle. An entrance side direct impingement nozzle 16 is connected to the entrance side of the overpressure nozzle 14, the direct impingement nozzle having nozzle orifices 17, and an exit side direct impingement nozzle 16' is connected to the exit side, this direct impingement nozzle having nozzle orifices 17'. The air discharge from the nozzle slots 20, 22 and the nozzle orifices 17, 17' is described in more detail in connection with FIG. 5.

In each nozzle assembly 12 the air flowing from nozzle slots 20 on the entrance side of the overpressure nozzle and from the nozzle orifices 17 of the direct impingement nozzle on the entrance side of this overpressure nozzle is discharged mainly through the discharge passage 18 on the entrance side of the nozzle assembly. Correspondingly, in each nozzle assembly 12 the air flowing from the nozzle slots 22 on the exit side of the overpressure nozzle, and from the nozzle orifices 17' of the direct impingement nozzle on the exit side of this direct impingement nozzle, is mainly discharged through the discharge passage (18') on the exit side of the nozzle assembly.

With the direct impingement nozzles in this advantageous solution of the invention the heat transfer can be intensified on both sides of the overpressure nozzle. In addition the arrangement (geometry) of the nozzle assemblies according to FIG. 1 has proved very advantageous regarding the runnability in airborne web-drying. Different factors affect the good runnability. Firstly, in this arrangement the web is supported at all points by the blows, at least on one side of the web. A web which partly has to travel without any support will easily flutter as it finds its correct path of travel, which causes troubles regarding the runnability. Secondly, in the solution according to FIG. 1 there is an overpressure nozzle on the opposite side of the web at each discharge passage for wet air, i.e. at that point where suction is directed at the web. This combined effect of suction and blow which is directed at the web and guides the web, alternately upward and alternately downward, will cause a stable sine-wave shaped motion in the web. Thirdly, direct impingement nozzles are arranged on both sides of the overpressure nozzle, in which case the planar surfaces of the direct impingement nozzles on their part stabilise the travel of the web.

Figure 2:
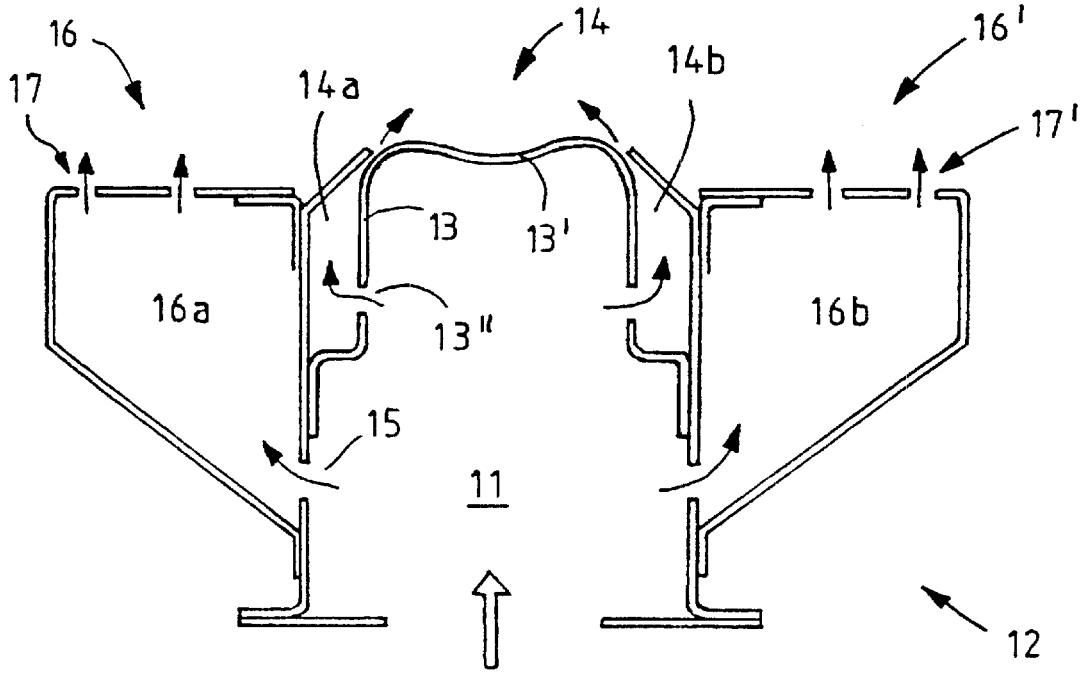
FIG. 2 shows schematically a vertical cross-section in the web's travel direction of one of the nozzle assemblies shown in FIG. 1.

FIG. 2 shows in an enlarged cross-section the nozzle assembly 12 according to FIG. 1, where a direct impingement nozzle part 16, 16' is arranged on both sides of the overpressure nozzle part 14. As can be seen in FIG. 2 the nozzle assembly is an integrated structure. The nozzle assembly has a common nozzle box 11.

Partitions 13 separating the entrance air side from the overpressure nozzle 14 are arranged in the nozzle box 11. That part 13' of the partition 13 which is directed toward the web forms the supporting surface of the overpressure nozzle, which in the case of FIG. 2 is shaped as a Coanda surface. Inlet channels 14*a*, 14*b* are formed between the partition 13 and both side walls of the nozzle box. The partition has openings 13" at the inlet channels, and air flows from these openings into the overpressure nozzles.

The inlet channels 16*a* and 16*b* of the direct impingement nozzle parts are connected to both sides of the nozzle box 11. At these inlet channels 16*a*, 16*b* the nozzle box 11 has in its side walls openings 15, from which entrance air flows into the direct impingement nozzles. The direct impingement nozzle according to FIG. 2 has a planar nozzle surface with nozzle orifices 17 in two adjacent rows.

The nozzle assembly according to FIG. 2 can be manufactured as a single beam-like structure, which is completely ready for installation and which makes the installation easier compared to conventional solutions, where each nozzle is brought as a separate part to the installation. Further it can be clearly seen in the figure that the nozzle assembly has a simple structure and that its manufacture and installation requires substantially less material and fastening members than the manufacture and installation of three separate nozzles.

Figure 3:
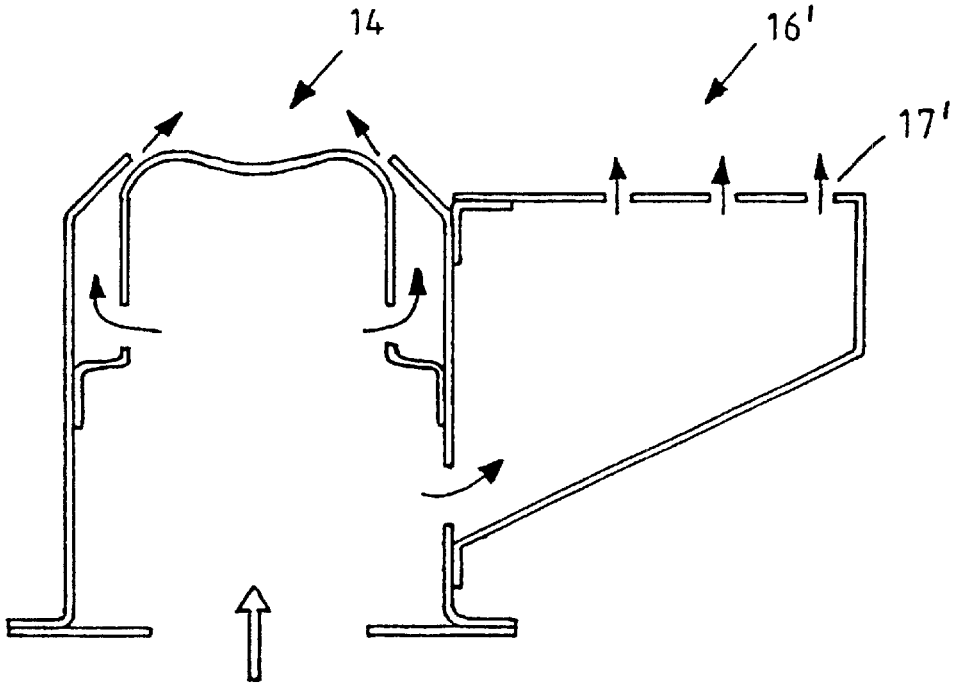
FIG. 3 shows a cross-section according to FIG. 2 of another nozzle assembly.

In a manner like that of FIG. 2 the FIG. 3 shows a nozzle assembly where a direct impingement nozzle 16' is connected only to one side of the overpressure nozzle part 14, typically on the exit side. The overpressure nozzle structure is the same as in FIG. 2. The direct impingement nozzle structure is almost the same as in FIG. 2. However, in the solution of FIG. 3 the direct impingement nozzle part 16' is larger than the corresponding nozzle part 16' in the solution of FIG. 2. Further the nozzle part 16' in FIG. 3 has three rows of nozzle orifices 17 instead of two, in order to obtain a larger open area.

Figure 4:
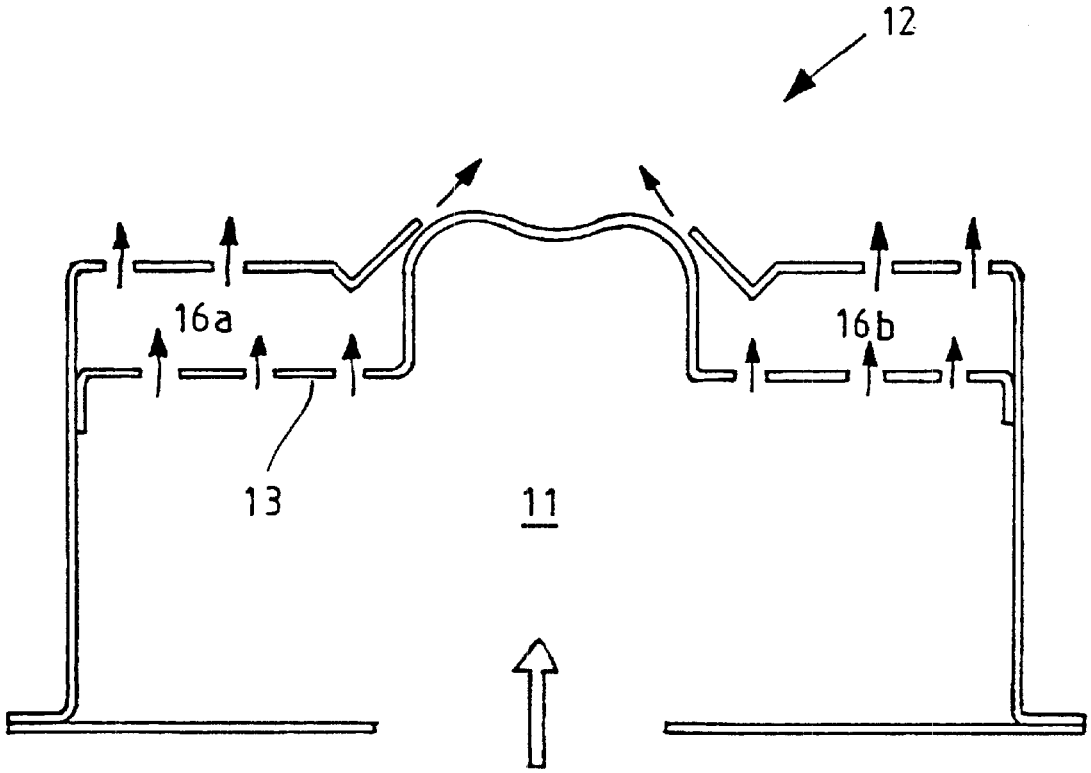
FIG. 4 shows a cross-section according to FIG. 2 of a third nozzle assembly.

FIG. 4 shows in a similar way as FIG. 2 a third nozzle assembly 12. In FIG. 4 the nozzle box 11 has mainly a width equal to that of the nozzle assembly 12. In that part of the nozzle box which is toward the web the partition 13 provided with openings forms two suction boxes, one box 16*a* for the nozzle orifices on the entrance side and another box 16*b* for the nozzle orifices on the exit side. From the air box 16*a* on the entrance side the air flows both to the nozzle orifices of the direct impingement nozzle on the entrance side and to the nozzle slot of the overpressure nozzle on the entrance side. Correspondingly, the air flows from the air box 16*b* on the exit side to the nozzle orifices of the overpressure nozzle on the exit side and to the nozzle slot of the overpressure nozzle on the exit side. Like the solution of FIGS. 2 and 3 the partition forms the Coanda-surface of the overpressure nozzle.

Figure 5:
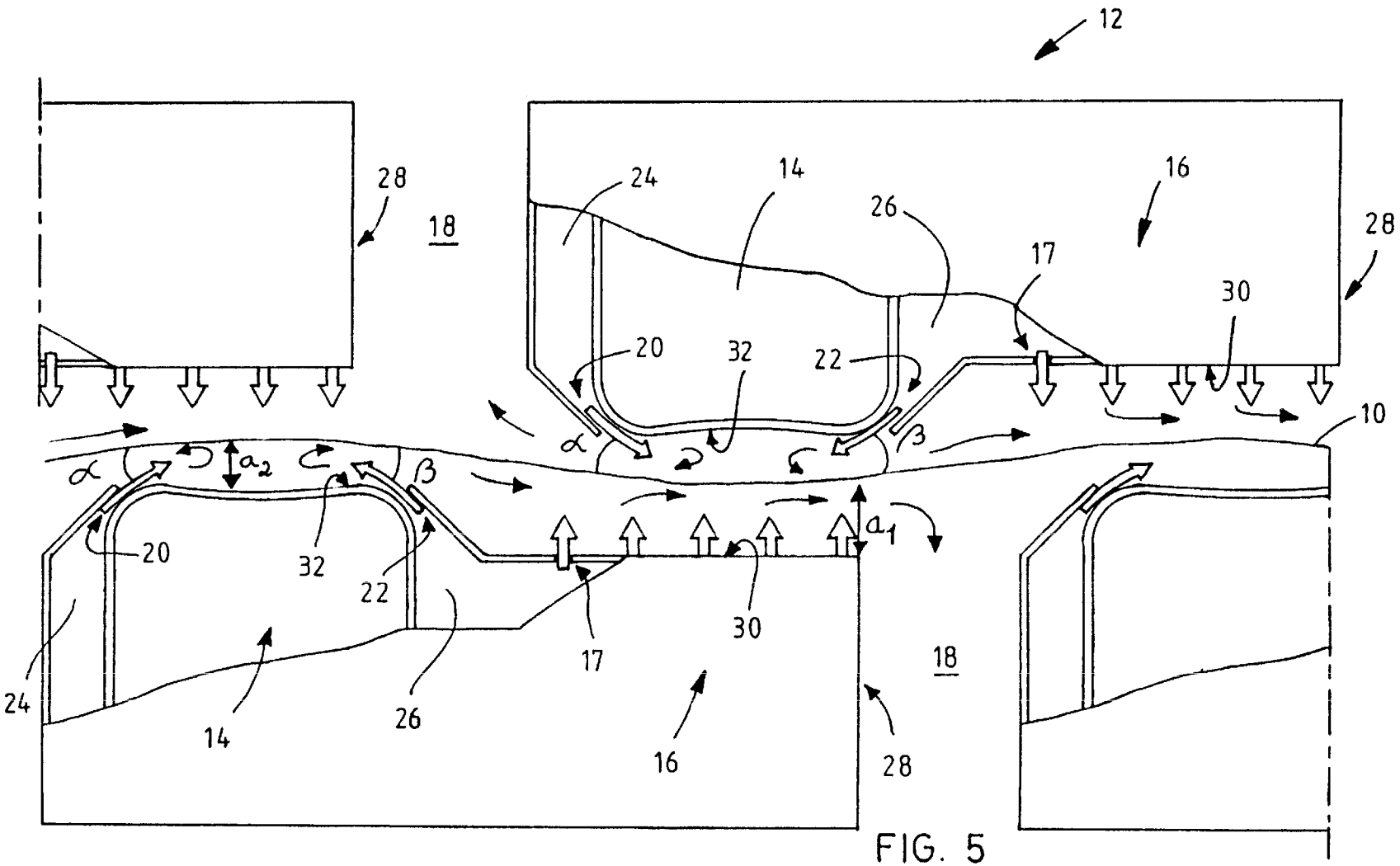
FIG. 5 shows schematically, as seen from one side and partly cut in the web's travel direction, a part of an airborne web-drying apparatus provided with a nozzle arrangement according to the invention.

FIG. 5, which for applicable parts uses the same reference numerals as FIG. 1, shows in more detail the paths of the air flows between the nozzle assembly and the web. In the case of FIG. 5 the air flows are illustrated as an example between the web and a nozzle assembly like that of FIG. 3.

In an airborne web-drying apparatus using a nozzle assembly according to FIG. 2 the air flows will travel between the exit side of the nozzle assembly and the web mainly in the same way as in FIG. 5. The air flows between the nozzle assembly according to FIG. 2 on the entrance side and the web are mainly mirror images of the air flows on the exit side.

In the case of FIG. 5 nozzle assemblies 12 according to the invention are arranged opposite each other on both sides of the web, so that an entrance side of a nozzle assembly and an exit side of a nozzle assembly are located opposite each other on the opposite sides of the web. In this case the discharge passage 18 for wet air and the center of a nozzle assembly will be located opposite each other on the opposite sides of the web.

In FIG. 5 on the entrance side 24 of the overpressure nozzle 14 there is a first slot or an entrance nozzle slot 20 and on the exit side 26 there is an exit nozzle slot 22. From the entrance nozzle slot air is discharged into the travel direction of the web, at a small angle $\alpha$ regarding the web. From the exit side nozzle slot air is discharged against the travel direction of the web, at a small angle $\beta$ regarding the web. The air flows discharged from the overpressure nozzle rise above the nozzle's supporting surface upwards toward the web, and turn then into a direction which is mainly opposite to their discharge direction, as shown by the thin arrows. The main part of the drying air discharged from the nozzle orifice 22 on the exit side 26 is discharged as wet discharge air or return air to the exit side of the nozzle 14 and further past the direct impingement nozzle through the discharge passage 18 on the exit side. The main part of the drying air discharged from the nozzle orifice 20 on the entrance side 24 is discharged as wet discharge air or return air through the discharge passage 18 formed on the entrance side of the nozzle. There may be a direct impingement nozzle part between the overpressure nozzle 14 and the discharge passage 18.

From the direct impingement nozzle 16, connected to the exit side 26 of the over pressure nozzle, drying air flows through the nozzle orifices 17 mainly perpendicularly against the web. The air turns in the web direction and is discharged together with the air coming from the overpressure nozzle as wet discharge air through the discharge passage 18 arranged on the exit side 28 of the nozzle assembly 12, as shown by the thin arrows.

The nozzle surface 30 of the direct impingement nozzle 16 is arranged so that its distance a, from web is larger than the distance $a_2$ of the supporting surface 32 of the overpressure nozzle 14 from the web. $a_1-a_2$=5 to 40 mm, typically 5 to 15 mm, advantageously about 10 mm. Supporting surface means that part of a nozzle which faces the web and which is limited to the region between the nozzle slots. Typically the supporting surface is parallel to the web line direction. The surface of the nozzle can contain a recess below the supporting surface. The larger distance between the direct impingement nozzle's nozzle surface or supporting surface and the web enables the drying air from the exit side of the overpressure nozzle to be discharged in the web's travel direction. The nozzle surface (30) and the supporting surface (32) can also be located at the same distance from the web, when desired.

Figure 6:
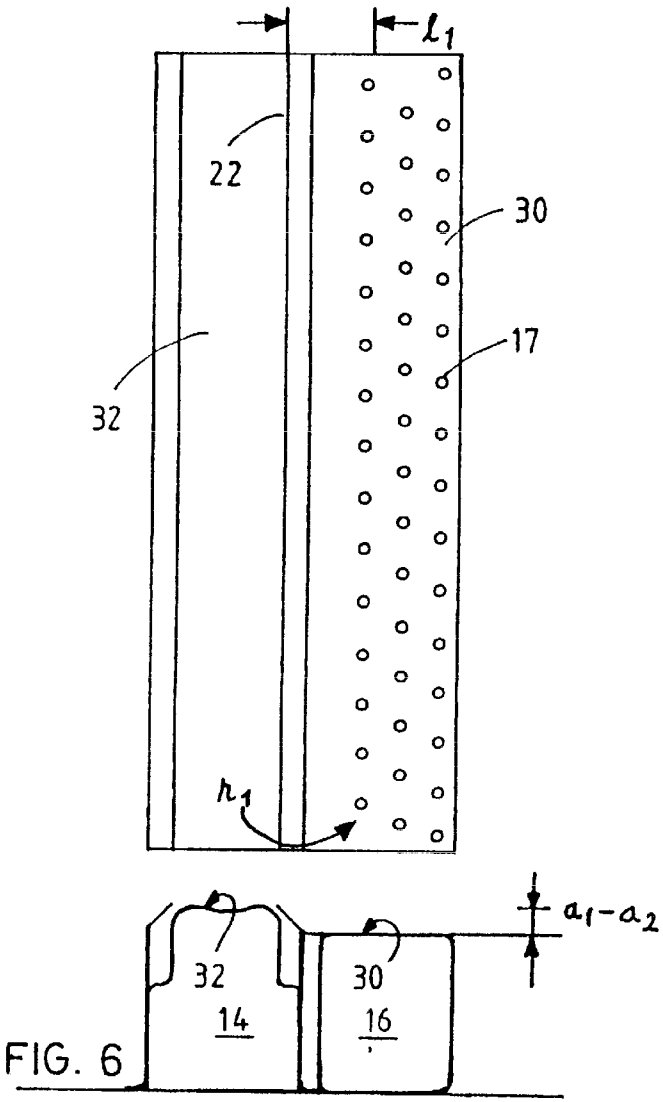
FIG. 6 shows schematically a nozzle assembly according to the invention in a cross-section along the web's travel direction and seen from above.

FIG. 6 shows a nozzle assembly according to the invention, both in a cross section and in a top view. This figure uses the same reference numerals as FIG. 1, when applicable. The distance between the nozzle surface 30 of the direct impingement nozzle 16 and the web is $a_1$, and the distance between the supporting surface 32 of the overpressure nozzle 14 and the web is $a_2$. The difference between these distances $a_1-a_2$ is about 5 to 15 mm, advantageously about 10 mm.

Figure 7:
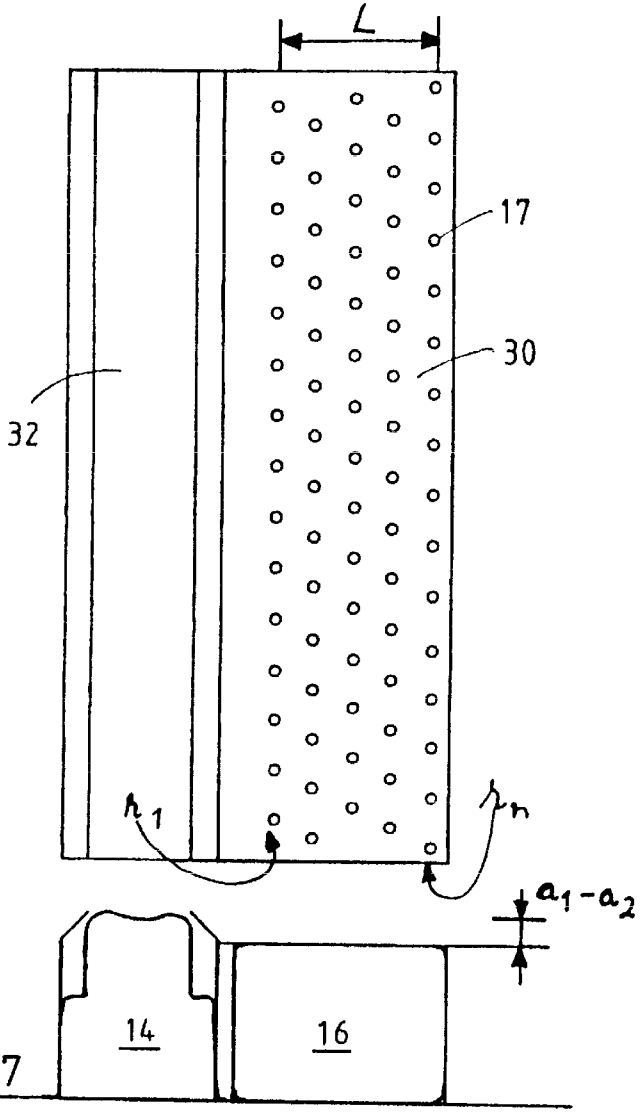
FIG. 7 shows according to FIG. 6 another nozzle assembly according to the invention.
Figure 8:
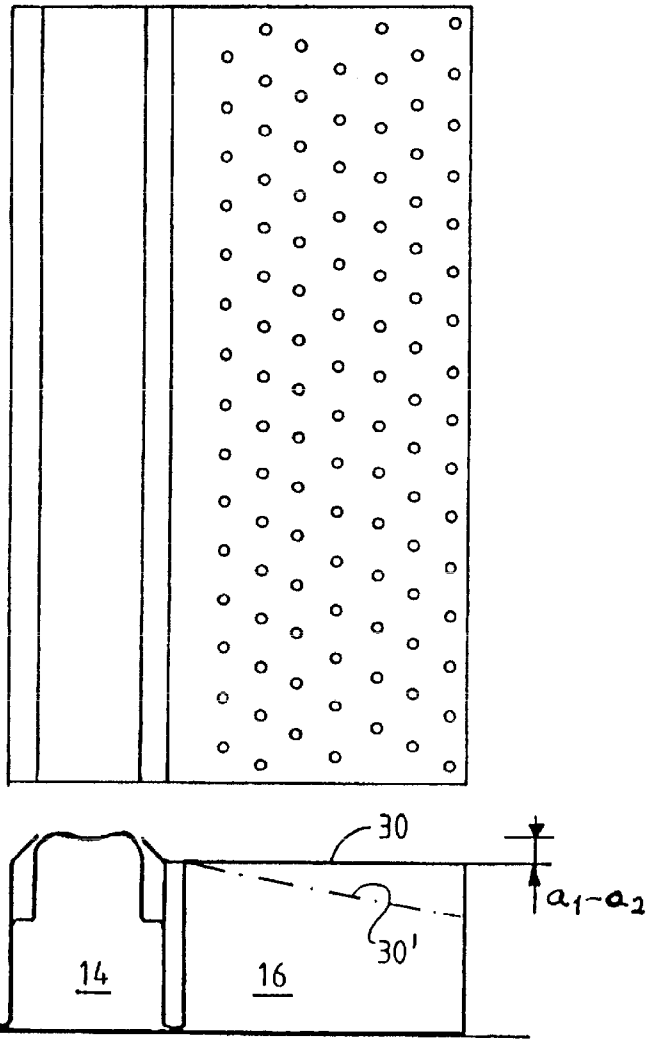
FIG. 8 shows according to FIG. 6 a third nozzle assembly according to the invention.

The nozzle orifices 17 of the direct impingement nozzle 16 in FIG. 6 are arranged in three rows of nozzle orifices. FIG. 7 presents another nozzle assembly according to the invention which differs from the former one in that the direct impingement nozzle 16 has five nozzle rows. FIG. 8 shows a third nozzle assembly according to the invention which differs from the former ones in that the direct impingement nozzle 16 has seven nozzle rows. The distance between the nozzle rows is about 20 to 30 mm. The distance between the nozzle orifices in the cross direction of the web is about 20 to 30 mm.

In the direct impingement nozzle 16 of FIG. 8 a possible modification 30' of the nozzle surface 30 is drawn with broken lines. The nozzle surface 30' is arranged obliquely, so that its distance from the web increases in the web's travel direction.

Figure 9:
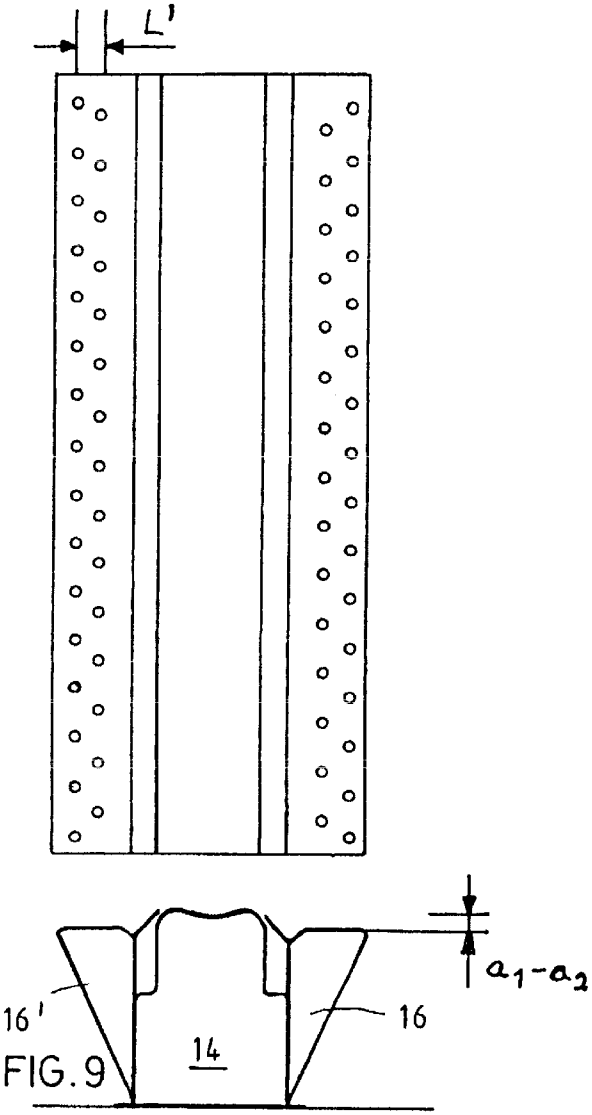
FIG. 9 shows according to FIG. 6 a fourth nozzle assembly according to the invention.

FIG. 9 shows a nozzle assembly which is similar to that of FIGS. 6 to 8, but which differs from the former in that a direct impingement nozzle 16, 16' is connected to both sides of the overpressure nozzle, in which case each direct impingement nozzle has two rows of nozzle orifices. However, the nozzle orifices can be located in only one row, or in more than two rows. By using a nozzle assembly of this kind it is possible to increase the heat-transfer coefficient both on the entrance side and on the exit side of the overpressure nozzle.

The solution provides a more efficient heat transfer with the same volume of drying air per square metre, which is considered to be an important advantage of the invention. On the other hand, compared to conventional drying using overpressure nozzles, substantially higher heat transfer effects can be achieved with the same blowing velocity but using a larger air volume per square metre, which is considered to be another important advantage of the invention.

Tests have shown that a nozzle assembly according to the invention can increase the heat-transfer coefficient on the section between the direct impingement nozzle and the web by about 100 $W/m^2/°$ C., compared to a situation which uses overpressure nozzles arranged one after another in a conventional manner, which leaves a discharge passage with a poor heat transfer between the nozzles. It has been found in the tests that the direct impingement nozzles have no detrimental effects on the heat transfer at the overpressure nozzle.

An assembly of overpressure nozzles and direct impingement nozzles in the same frame structure in the manner according to the invention will further provide substantial advantages in material saving, as well as advantages regarding production techniques, installation techniques and the amount of work.

With a suitable nozzle arrangement it is further possible to achieve a highly stable web run and a good runnability, by arranging e.g. an overpressure nozzle opposite the discharge passage for wet air, and by combining a suitable direct impingement nozzle on the entrance side and the exit side of the overpressure nozzle.

The invention is not intended to be limited to the above presented embodiments, but the intention is to apply the invention widely within the inventive idea defined by the claims presented below.

What is claimed is:

1. A nozzle arrangement in an airborne web-drying apparatus for drying a coated fibre web, wherein the web has a travel direction which defines an upstream direction and a downstream direction, comprising:

a plurality of first nozzle assemblies positioned on a first side of the web and extending across the web, the first nozzle assemblies defining first discharge passages therebetween which extend across the web, the first discharge passages for wet discharge air;

a plurality of second nozzle assemblies positioned on a second side opposite the first side of the web and extending across the web, the second nozzle assemblies defining second discharge passages therebetween for wet discharge air, the first nozzle assemblies and the second nozzle assemblies positioned so that each first discharge passage is opposite a second nozzle assembly, and each second discharge passage is opposite a first nozzle assembly;

wherein each first nozzle assembly and each second nozzle assembly comprises:

at least one overpressure nozzle extending across the web, the at least one overpressure nozzle having a first upstream nozzle slot extending across the web and a second downstream nozzle slot extending across the web, arranged to blow drying air jets obliquely against each other; and at least one direct impingement nozzle extending across the web and having a plurality of nozzle slots or nozzle orifices for blowing drying air mainly perpendicularly against the web.

2. The nozzle arrangement of claim 1 wherein the first upstream nozzle slot and the second downstream nozzle slot of each nozzle assembly are guided against each other with the aid of curved Coanda-surfaces.

3. The nozzle arrangement of claim 1 wherein the at least one overpressure nozzle first upstream nozzle slot is a single slot and the second downstream nozzle slot is a single slot.

4. The nozzle arrangement of claim 1 wherein each first upstream nozzle slot and second downstream nozzle slot comprises a row of successive nozzle orifices extending across the web.

5. The nozzle arrangement of claim 1 wherein each first nozzle assembly and each second nozzle assembly comprises two direct impingement nozzles combined with the at least one overpressure nozzle, one of said two direct impingement nozzles positioned on an upstream side of the at least one overpressure nozzle and a second of said two direct impingement nozzles positioned on a downstream side of the at least one overpressure nozzle.

6. The nozzle arrangement of claim 5 wherein in each nozzle assembly the orifices of said two direct impingement nozzles define a total area which is about 40 to 150% of a total area defined by the first upstream nozzle slot and the second downstream nozzle slot of the overpressure nozzle.

7. The nozzle arrangement of claim 1 wherein the first and second discharge passages have a total area which is less than 40% of a total area defined by the first nozzle assemblies, the second nozzle assemblies and the first discharge passages and second discharge passages.

8. The nozzle arrangement of claim 1 wherein the at least one direct impingement nozzle of one of the nozzle assemblies has a nozzle surface, and defines a first perpendicular distance from the nozzle surface to the web, and wherein said at least one of the nozzle assemblies has portions of the overpressure nozzle which define a supporting surface, and wherein a second perpendicular distance is defined from the supporting surface to the web, the first perpendicular distance being 5 to 40 mm greater than the second perpendicular distance.

9. The nozzle arrangement of claim 1 wherein the at least one direct impingement nozzle of each first nozzle assembly and each second nozzle assembly has a nozzle surface, and wherein a first perpendicular distance is defined measured from the nozzle surface to a line defined by the web, and the first perpendicular distance is from about 20 mm to 30 mm.

10. The nozzle arrangement of claim 1 wherein in each of said first nozzle assemblies and said second nozzle assemblies, the distance between the second downstream nozzle slot of the each overpressure nozzle and the closest downstream nozzle slot or nozzle orifices of the at least one direct impingement nozzle is greater than 30 mm, and less than 100 mm.

11. The nozzle arrangement of claim 1 wherein the at least one direct impingement nozzle has nozzle nozzle slots or nozzle orifice in a region, defined in the travel direction of the web, which has a length of 20 to 250 mm.

12. The nozzle arrangement of claim 1 wherein the nozzle orifices of the at least one direct impingement nozzle are arranged in two to seven rows which are successive in the travel direction of the web, and wherein the nozzle orifices in successive rows are arranged in an overlapping manner.

13. The nozzle arrangement of claim 1 wherein the diameter of the nozzle orifices of the at least one direct impingement nozzle is about 2 to 10 mm, and wherein the width of the first and second nozzle slots of the at least one overpressure nozzle is about 1.5 mm.

14. The nozzle arrangement of claim 1 wherein the orifices of the at least one direct impingement nozzle define a total area which is about 40 to 100% of a total area defined by the first and second nozzle slots of the overpressure nozzle.

15. The nozzle arrangement of claim 1 wherein in each nozzle assembly the first upstream nozzle slot and the second downstream nozzle slot of the overpressure nozzle have an area which is 1 to 2%, of an area defined by the overpressure nozzle, and the nozzle slots or nozzle orifices of the direct impingement nozzle define an open area of about 0.5 to 1.5%, of an area defined by the direct impingement nozzle.

16. The nozzle arrangement of claim 1 wherein each first nozzle assembly and each second nozzle assembly is arranged so that one direct impingement nozzle is arranged on an upstream side one overpressure nozzle.

17. The nozzle arrangement of claim 1 wherein each first nozzle assembly and each second nozzle assembly is arranged so one direct impingement nozzle is arranged on a downstream side of one overpressure nozzle.

18. The nozzle arrangement of claim 1 wherein the direct impingement nozzle defines a surface in which are formed the orifices of the direct impingement nozzle, the surface being inclined, so that its distance from the web increases in the travel direction of the web.

19. A method for for drying a coated fibre web comprising the steps of:

passing a coated fibre web, passing from upstream to downstream between a plurality of first nozzle assemblies positioned on a first side of the web and extending across the web, the first nozzle assemblies defining first discharge passages therebetween which extend across the web, the first discharge passages for wet discharge air, and a plurality of second nozzle assemblies positioned on a second side opposite the first side of the web and extending across the web, the second nozzle assemblies defining second discharge passages therebetween for wet discharge air, the first nozzle assemblies and the second nozzle assemblies positioned so that each first discharge passage is opposite a second nozzle assembly, and each second discharge passage is opposite a first nozzle assembly;

wherein each first nozzle assembly and each second nozzle assembly comprises:

at least one overpressure nozzle extending across the web and having an upstream side and a downstream side, the overpressure nozzle having a first upstream nozzle slot extending across the web and a second downstream nozzle slot, which blow drying air jets obliquely against each other; and at least one direct impingement nozzle extending across the web, having a plurality of nozzle slots or nozzle orifices which blow drying air mainly perpendicularly against the web; and discharging wet air formed by the drying air jets of the overpressure nozzle and the drying air of the direct impingement nozzle away from the web through the first and second discharge passages.

20. The method of claim 17, wherein each direct impingement nozzle has a nozzle surface positioned a first distance from the web, and wherein each overpressure nozzle has a surface defined between the first upstream nozzle slot and the second downstream nozzle slot, and the distance between each overpressure nozzle surface and the web is less than the first distance.

21. The method of claim 17, wherein at least one direct impingement nozzle is arranged on a downstream side of each overpressure nozzle, and wherein wet air, formed by the drying air blown from the downstream nozzle slot of the overpressure nozzle and the drying air from the direct impingement nozzle arranged on the downstream side of the overpressure nozzle, is guided away from the web through one of said first and second discharge passages which is formed downstream of the direct impingement nozzle.

22. The method of claim 17, wherein wet air, formed by the drying air blown from the upstream nozzle slot of each overpressure nozzle, is guided away from the web through one of said first and second discharge passages which is formed upstream of the direct impingement nozzle.

23. A nozzle arrangement in an airborne web-drying apparatus for drying a coated fibre web, wherein the web has a travel direction which defines an upstream direction and a downstream direction, comprising:

a plurality of first nozzle assemblies positioned on a first side of the web and extending across the web, the first nozzle assemblies defining first discharge passages therebetween which extend across the web, the first discharge passages for wet discharge air;

a plurality of second nozzle assemblies positioned on a second side opposite the first side of the web and extending across the web, the second nozzle assemblies defining second discharge passages therebetween for wet discharge air, the first nozzle assemblies and the second nozzle assemblies positioned so that each first discharge passage is opposite a second nozzle assembly, and each second discharge passage is opposite a first nozzle assembly;

wherein each first nozzle assembly and each second nozzle assembly comprises:

at least one overpressure nozzle extending across the web, the at least one, overpressure nozzle having a first upstream a means for blowing air extending across the web and a second downstream means for blowing air extending across the web, arranged to blow drying air jets obliquely against each other; and at least one direct impingement nozzle extending across the web and having means for blowing drying air mainly perpendicularly against the web.

* * * * *